US005403090A

United States Patent [19]

Hofer et al.

[11] Patent Number: 5,403,090

[45] Date of Patent: Apr. 4, 1995

[54] TABLET DISSOLUTION CENTERING DEVICE

[76] Inventors: Henry Hofer, 30 Bruce Dr., East Hanover, N.J. 07936; James E. Swon, 12 Twin Park Dr., Brookside, N.J. 07926

[21] Appl. No.: 850,313

[22] Filed: Mar. 12, 1992

[51] Int. Cl.[6] ..... B01F 15/60; B01F 7/16

[52] U.S. Cl. ..... 366/142; 366/207; 366/286

[58] Field of Search ..... 73/455, 457, 460, 462, 73/866; 366/142, 197, 198, 199, 207, 242, 244, 245, 279, 286; 422/63, 64, 65

[56] References Cited

U.S. PATENT DOCUMENTS

| | | | |
|---|---|---|---|
| 1,320,766 | 11/1919 | Knott | 366/286 |
| 1,418,749 | 6/1922 | Trust | 366/197 |
| 1,513,641 | 10/1924 | Simmons | 73/460 |
| 1,803,446 | 5/1931 | Warwick | 366/207 |
| 2,193,934 | 3/1940 | Moores | 366/197 |
| 2,802,649 | 8/1957 | Stockton | 366/197 |
| 2,848,817 | 8/1958 | Smith | 73/460 |
| 2,981,112 | 4/1961 | Lash | 73/462 |
| 4,184,776 | 1/1980 | Shamparier | 366/198 |
| 4,299,500 | 11/1981 | Basetti | 366/198 |
| 4,527,904 | 7/1983 | Weetman | 366/349 |
| 4,671,172 | 6/1987 | Stiglich | 366/197 |
| 4,751,052 | 6/1988 | Schwartz | 422/63 |
| 4,893,939 | 11/1990 | Burk | 366/286 |

*Primary Examiner*—David A. Scherbel
*Assistant Examiner*—Terrence R. Till
*Attorney, Agent, or Firm*—William T. Hough

[57] ABSTRACT

In a preferred embodimeñt, a vessel-mouth annulus that precisely fits the inside-diameter of the upper mouth-opening to a water-containable tablet-dissolution stirring vessel, the vessel-mouth annulus being rigidly mounted on an anchoring structure rigidly attached to a paddle-shaft stirring device with one or more of the anchoring arm and/or the paddle-shaft stirring device being mounted in a predetermined fixed position on a base support structure such that a center of the dissolution vessel is centered in exact alignment with a predetermined fixed-position of a downwardly-extending lineally-extending stirrer-paddle shaft on which at-least one stirrer paddle is mounted on a lower end thereof for stirring liquid contained in the dissolution vessel during its operational use, and dissolution vessel support structure positioned to support the dissolution vessel in a state of alignment when the dissolution vessel is pressed upwardly against the aligning guide and holding means in a state of being aligned against inside diameter surfaces of the dissolution vessel. Additionally, rigidly and immovably a part of or mounted on at-least one of the vessel-mouth annulus and/or the anchoring structure and/or the paddle-shaft stirring device, there is included mounting structure for mounting a shaft-centering tester such that continuously or intermittently the revolvable shaft mounting the paddles, may be tested to verify continued exact centered positioning thereof relative to the centered mouth of the dissolution vessel. The tester-mounting structure is adapted to intermittently mount and dismount the the shaft-centering tester.

13 Claims, 8 Drawing Sheets

TABLET DISSOLUTION CENTERING DEVICE

PRIOR ART

Prior to the present invention, there have existed different gadgets for ascertaining the alignment of central points of a dissolution vessel mouth with a downwardly-extending lineally-extending paddle-carrying revolvable shaft of a stirring motor mounted on a support structure, requiring the shifting-about of the dissolution vessel until hopefully aligned, and while manually attempting to maintain the alignment, fastening-down the dissolution vessel hopefully in that aligned position and to hopefully prevent shifting from alignment during use thereof, during the stirring of liquid therein. Another typical prior art device provides a fixed structure having a through-passage therein having an inner-diameter that matches the outer-diameter of the dissolution vessel, with the fixed structure being in a rigid fixed relationship to the stirrer mounting structure such that hopefully the downwardly lineally-extending revolvable shaft of the stirrer will be centered in a dissolution vessel placed in the through-passage receivable of the dissolution vessel. A prior art search was conducted in the United States Patent and Trademark Office appropriate classes and subclasses. No revelant prior art patents were located in that novelty search.

BACKGROUND TO THE INVENTION

The field of use for the present invention and the above-noted prior art is for the testing of drug-dissolution rates of tablets and the like when placed in a dissolution vessel containing stirred water—continuously stirred by paddles mounted on the lower end of a downwardly lineally-extending revolvable shaft from a stirrer motor. The government regulators and inspectors for drug-tablet producing manufacturers require that the downwardly extending lineally-extending revolvable shaft (that has paddle-blades mounted on its bottom) always be the same position, centered within the mouth of the vessel, in order to prevent undetected variations in dissolution [if the paddle stirring varied from test to test, different inaccurate dissolution rates would be registered incorrectly].

Of equal or more importance, the vessel that normally looks-Like an over-sized test-tube, actually a water-containing vessel about 8 inches deep with a round hemispherical bottom so that there are no dead-spaces of liquid around the bottom, must be centered, as hopefully mounted and thereafter maintained against effects of vibrations or other contributing factors that could lead in accidental non-alignment, within a dissolution vessel-support—relative to the central position of the downwardly-extending paddle-stirring columnar-shaft (above-noted) of the stirrer.

Apart from the possibility that initial alignment heretofore by prior art apparatus and methods of use thereof to attempt to secure proper alignment, in fact often failed in the attempt, even when reasonably aligned, the stirrer shaft is sometimes removed and reinserted. While the mere repositioning or remounting of the revolvable mixer blade-containing shaft might result in misalignment to a non-aligned state, there also exists a real possibility that the mere cumbersom handling or dropping of the blade-containing shaft onto a counter-top could cause the very sensitive shaft to become bent slightly—such slight bending being more than enough to totally destroy any possibility of alignment, and such bent or distorted bladed-shaft thereafter when revolved causing vibrating and the concurrent non-controlled varying erratic stirring of the water contents in the dissolution vessel—a condition unacceptable to government regulators and inspectors.

Objects of the Invention

Accordingly, objects of the present invention broadly are to overcome and/or avoid the problems and/or disadvantages above-noted of prior gadgets and/or methods.

More particularly, an object is to remove variables, creating more constants, such that mounting of a dissolution vessel automatically results in a constant and accurate alignment not readily subject to loss of alignment and devoid of the human factor resulting from heretofor cumbersome handling and securing of the manually-held dissolution vessels.

Another object is to provide for a predetermined non-changing mounting of a tester for either intermittently or continually ascertaining and/or verifying continued proper alignment during any operation and/or between intermittent phases of the same operation, relative to stable predetermined centering devices for mounting the dissolution vessels.

Another object is to provide for a removably mountable tester for the intermittent testing thereby of a plurality of different dissolution vessels and stirrers thereof concurrently being prepared or operated, by intermittent mounting thereof on the prepositioned fixed mounting positions thereof, relative to stable predetermined centering devices for mounting the dissolution vessels.

Other objects become apparent from the preceding and following disclosure.

Broad Description of the Invention

In a first broad statement of the invention, there is a tablet dissolution vessel centering device inclusive of a dissolution-vessel support and aligning guide structure and mechanism thereof, stirring structure and mechanism thereof, stirring structure, support structure, anchoring structure and mechanism thereof, and dissolution vessel support structure. The dissolution-vessel support and aligning guide structure and mechanism thereof are adapted for aligning inside diameter surfaces of a dissolution vessel such that a center of the dissolution vessel is centered in exact alignment with a predetermined fixed-position of a downwardly-extending linerally-extending stirrer-paddle shaft on which atleast one stirrer paddle is mounted on a lower end thereof for stirring liquid contained in the dissolution vessel during its operational use. The stirring structure and mechanism thereof are adapted for stirring dissolvable matter within the liquid, typically water, contained in the dissolution vessel during its operational stirring use. The stirring structure and mechanism thereof include the downwardly-extending lineally-extending stirrer-paddle shaft. The stirring-structure support structure for supporting the stirring structure and mechanism thereof are in a predetermined fixed stirring position, adjustable intermittently. Dissolution vessel locking structure and mechanism thereof are positioned to support said dissolution vessel in a centered state and position of the exact initial alignment when said inner diameter surfaces of said dissolution vessel are pressed upwardly against the dissolution-vessel support and aligning guide structure and mechanism thereof, in a state of being aligned against inside diameter surfaces of the dissolution vessel. The anchoring structure and mechanism thereof are adapted for mounting the stirring-structure and mechanism thereof support structure in a predetermined position such that the center of the dissolution vessel is always centered in exact alignment with a fixed-position of the downwardly-extending stirrer-paddle shaft of the stirring structure and mechanism thereof. The dissolution vessel support structure are positioned and adapted to support the dissolution vessel in a state of alignment when the dissolution vessel is pressed upwardly against the aligning guide and holding structure and mechanism thereof in a state of being aligned against inside diameter surfaces of the dissolution vessel.

In a first preferred embodiment, as an improvement on the first broad embodiment above-described, the dissolution-vessel support and aligning guide structure and mechanism thereof include a vessel-mouth annular member having predetermined outer-diameter spaced-apart surfaces thereof positioned to concurrently fit against inside-diameter surfaces of a mouth of a dissolution vessel supported by the dissolution vessel support structure such that the dissolution vessel becomes centrally aligned and maintained thereat when being pressed against the inside-diameter surfaces.

In a second preferred embodiment, there is included a stirring shaft alignment-tester stably and non-shiftably mounted on support structure or locking structure and mechanism thereof for supporting and locking-in a dissolution vessel, locked into the above-noted predetermined fixed stirring position whereby the stir ringshaft and mechanism thereof are adapted for mounting a stirring shaft alignment-tester in a predetermined position positioned. Thereby the stirring shaft alignment-tester establishes exact location of the downwardly-extending lineally-extending stirrer-paddle shaft when the downwardly-extending lineally-extending stirrer-paddle is in apparent central alignment with the center of the vessel-mouth annular member for its inside diameter surfaces after the dissolution vessel has its inside diameter surfaces positioned such that a center of the dissolution vessel's inner diameter is centered for initial exact alignment with the above-noted predetermined fixed-position.

In a third preferred embodiment, the stirring shaft alignment-tester mounting structure and mechanism thereof is structured for intermittently receiving and locking and for intermittently unlocking and removing the stirring shaft alignment-tester.

In a fourth preferred embodiment, the dissolution-vessel support and aligning guide structure and mechanism thereof and the anchoring structure and mechanism thereof include common mounting structure providing for fixed spacial and positioning relationships of one to the other thereof.

In a fifth preferred embodiment, the dissolution vessel has an upper mouth having outer circumscribing surfaces, and the dissolution-vessel locking structure and mechanism thereof include intermittently lockable and releasable fastening structures spaced-apart from one-another in predetermined fastening positions on the dissolution vessel support structure positioned around the upper mouth and outer circumscribing surfaces thereof when the dissolution vessel is pressed upwardly against the aligning and holding structure and mechanism thereof.

In a sixth preferred embodiment, the stirring-structure and mechanism thereof support structure are adjustably adaptable such that the stirring-structure and mechanism thereof support are additionally for at-least one of initially positioning or subsequently repositioning the stirring structure and mechanism thereof thereby to initially establish or to reestablish an accurate positioning of the downwardly-extending lineally-extending stirrer-paddle shaft to the above-noted predetermined centered state and position between opposite inner diameter surfaces of the dissolution vessel when the dissolution vessel is pressed upwardly against the aligning guide and holding structure and mechanism thereof.

In a seventh preferred embodiment, as an improvement on the first broad embodiment above-described, there are included stirring shaft alignment-tester mounting structure and mechanism thereof for stably and non-shiftingly mounting on support structure or locking structure for a dissolution vessel, a stirring shaft alignment-tester in a predetermined position positioned such that the stirring shaft alignment-tester establishes exact location of the downwardly-extending lineally-extending stirrer-paddle shaft when the downwardly-extending lineally-extending stirrer-paddle shaft is positioned to be in apparent central alignment with the center of the vessel-mouth annular member for its inside diameter surfaces when the dissolution vessel has its inside diameter surfaces positioned such that a center of the dissolution vessel's inner diameter is centered for initial exact alignment with the predetermined fixed-position.

In an eighth preferred embodiment as an improvement on the seventh preferred embodiment, the stirring shaft alignment-tester mounting structure and mechanism thereof are structured for intermittently receiving and locking and for intermittently unlocking and removing the stirring shaft alignment-tester.

In a ninth preferred embodiment as an improvement on the eighth preferred embodiment, the dissolution-vessel support and aligning guide structure and mechanism thereof and the anchoring structure and mechanism thereof include common mounting structure providing for fixed spacial and positioning relationships of one to the other thereof.

In a tenth preferred embodiment as an improvement on the ninth preferred embodiment, there is included the dissolution vessel as a part of the inventive combination, and the dissolution vessel has an upper mouth having outer circumscribing surfaces, and the dissolution-vessel support and aligning guide structure and mechanism thereof include intermittently lockable and releasable fastening structures spaced-apart from one-another in predetermined fastening positions on the dissolution vessel support structure positioned around the upper mouth and outer circumscribing surfaces thereof when the dissolution vessel is pressed upwardly against the aligning and holding structure and mechanism thereof.

In an eleventh preferred embodiment as an improvement on the tenth preferred embodiment, the stirring-structure and mechanism thereof support structure are adjustably adaptable such that the stirring-structure and mechanism thereof support are additionally for at-least one of initially positioning and/or subsequently repositioning the stirring structure and mechanism thereof thereby to initially establish and/or to reestablish the downwardly-extending lineally-extending stirrer-paddle shaft to the predetermined fixed stirring position at a centered location between opposite inner diameter surfaces of the dissolution vessel when the dissolution vessel is pressed upwardly against dissolution-vessel support and aligning guide structure and mechanism thereof.

In a second broad embodiment, there is a stirring shaft alignment-tester mounting structure and mechanism thereof adapted for mounting a stirring shaft alignment-tester on support structure or locking structure for a dissolution vessel, in a predetermined position positioned relative to a common support structure-mounted downwardly-extending lineally-extending stirrer-paddle shaft such that the stirring shaft alignment-tester establishes exact location of the downwardly-extending lineally-extending stirrer-paddle shaft when the downwardly-extending lineally-extending stirrer-paddle shaft is properly aligned in a predetermined position at which it is centered within a dissolution vessel. Thereby the fixedly-mounted tester allows for immediate and reliable testing and any necessary adjustments and/or replacement of a warped or bent stirring rod (shaft) by virtue of the stirring shaft alignment-tester mounting structure and mechanism thereof both when initially mounting a dissolution vessel with its water (normally) dissolution liquid with the stirring rod or shaft downwardly-extending into the water for the agitation of dissolvable matter therein, as well as intermittently during procedural step(s) and/or intermittent removal of the downwardly-extending lineally-extending stirrer-paddle shaft (or rod), for or during checking or reestablishing central alignment of the shaft within the mouth of the dissolution vessel.

In a twelfth preferred embodiment as an improvement on the second broad embodiment, there is included intermittently alternate lockable and releasable tester mounting structure and mechanism for intermittently mounting and/or for removing the tester. The tester mounting structure and mechanism thereof thereby provide for the tester to be rotated (switched) between a plurality of other dissolution testing positions, for the checking of variations and/or potentially needed adjustments of alignments of those dissolution vessels and/or replacement of the stirring shaft(s) (rods) thereof when bent or otherwise warped.

In a thirteenth preferred embodiment as an improvement on the twelfth preferred embodiment, there is provided a monitoring structure and mechanism connected to and receiving output signals from the gauge as the spring-biased gauge registers serially measured positions of revolving surfaces of the donwardly-extending lineally-extending stirrer-paddle shaft (or rod), for or during checking or reestablishing central alignment of the shaft within the mouth of the dissolution vessel, the monitoring structure and mechanism providing a visual reading of the serially measured positions such that error in positioning and/or presence or absence of "run-out" may be ascertained.

The invention may be belief understood by reference to the Figures.

THE FIGURES

FIG. 1 diagrammatically illustrates an embodiment of the present invention illustrated as mounted on a conventional holed-table or platform in which a conventional test-tube shaped dissolution vessel is seated in the structure defining the hole s circumference, illustrated in side view with cross-section of the platform and showning the seated dissolution vessel in-part, in phantom.

FIG. 2A diagrammatically illustrates an in-part or partial-top view of the embodiment of FIG. 1, as taken along lines 2—2 of FIG. 1, showing the support structure shaft in cross-section.

FIG. 2B diagrammatically illustrates a top in-part view as taken along lines 2B—2B of FIG. 1, better illustrating the continuing structure of FIG. 2A, illustrated in FIG. 1. This Figure better shows the contact of the spring-biased gauge-shaft 27 and its contacting end **27*a* in contact with downwardly-extending shaft 14 (shown in cross-section), and the relative reciprocal movement directions 27*b*, and the annulus hole (through-space) 12 of the annular structure 12*bb***.

FIG. 3 diagrammatically illustrates a more typical view of a holed table-or platform, having spaced-apart holes for the seating therein of dissolution vessels of slightly less outer diameter but adequate for supporting by the lips of the dissolution vessels, having mounted on the face of the platform shown in perspective from and side view, various typical mounting structures utilized in one embodiment of the invention.

FIG. 4 diagrammatically illustrates a typical conventional spring-biased gauge for measuring shaft wobble and/or non-vertical alignment, as a part of the invention's combination support structure and mechanism for mounting on the afore-stated platform (not illustrated in this illustration) shown in a bottom and side and forward perspective view.

FIG. 5 diagrammatically illustrates the same embodiment as that of FIG. 4, taken along the lines 5—5 of FIG. 4, as a top view thereof.

FIG. 6 diagrammatically illustrates an in-part view of an alternate vessel-engaging and aligning structure of typically the embodiment of FIG. 1, as a typical top view thereof illustrating a semicircular embodiment.

FIG. 7 diagrammatically illustrates a side view in partial cross-section, of the embodiment of FIG. 6 as taken along lines 7—7 of FIG. 6, illustrating both a semicircular embodiment and also a differently-shaped outer-diameter surface for engaging the top and inner-diameter surfaces of a dissolution vessel, obviating need for or any advantages of an intermediate annular or semiannular gasket of the type illustrated in the embodiment of FIGS. 1 through 2B.

FIGS. 8A and 8B diagrammatically illustrate an alternate embodiment of the invention of foregoing Figures, in an in-part and exploded front, side and top perspective view, particularly additionally illustrating a multiple stirrer embodiment.

FIG. 9A-1 diagrammatically illustrates one of the elements of the embodiment of FIGS. 8A and 8B, in a top corner perspective view, namely the vessel-engaging and aligning structure thereof.

FIG. 9B-1 diagrammatically illustrates a side cross-sectional view of the embodiment of FIG. 9A-1 as taken along line 9B-1–9B-1 thereof.

FIG. 9A-2 diagrammatically illustrates an alternate embodiment to that of FIG. 9A-1, also illustrated in a top corner perspective view, for this alternate vessel-engaging and aligning structure.

FIG. 9B-2 diagrammatically illustrates as taken along line 9B-2–9B-2 of FIG. 9A-2, illustrates a view for this embodiment—which view corresponds to that of FIG. 9B-1 for the embodiment of FIG. 9A-1.

FIG. 10 diagrammatically illustrates an alternate mounting combination of the above-noted gauge shown in a front, corner and top perspective view thereof, together with an illustrative computer component of this particular embodiment of the invention.

FIG. 11 diagrammatically illustrates an alternate embodiment of the invention in a front, top and side perspective view, in which motor drives, readout structures and mechanisms thereof and supports for the plurality of downwardly-extending drives as a composite combination move upwardly and downwardly alternately, by ratchet drives or the like above the support and aligning structures and mechanisms thereof adapted centering the plurality of dissolution vessels mountable on a common platform plate below.

DETAILED DESCRIPTION

While the foregoing Figures illustrates both different views of common embodiments, as well as different views of alternate embodiments of the invention, identical indicia are utilized for common elements, and related indicia are utilized for related elements. Once an element is identified for one drawing and/or embodiment, description thereof or for related indicia are not thereafter repeated, except in some instances in order to facilitate understanding and clarity.

Figure 1:
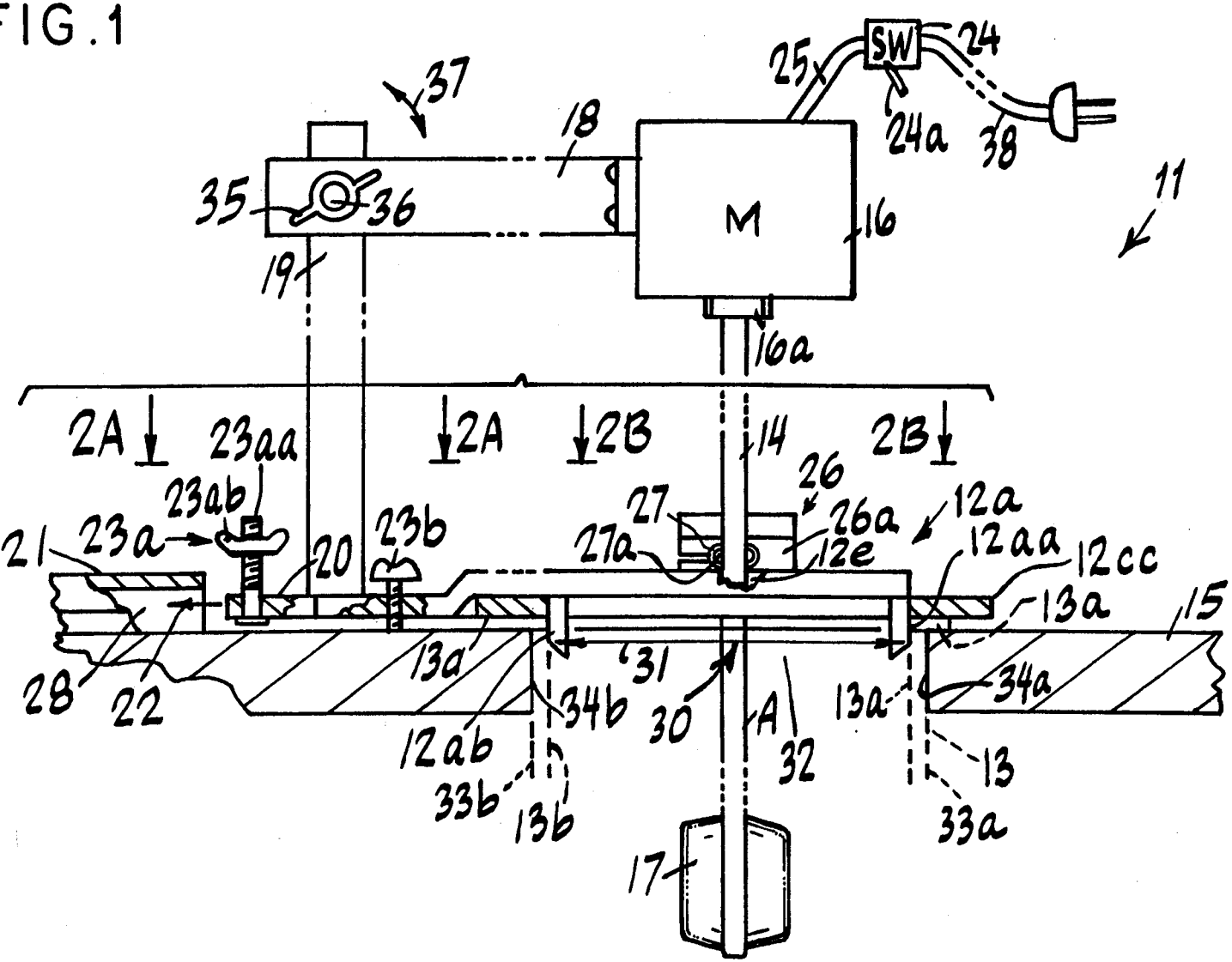
Figure 6:
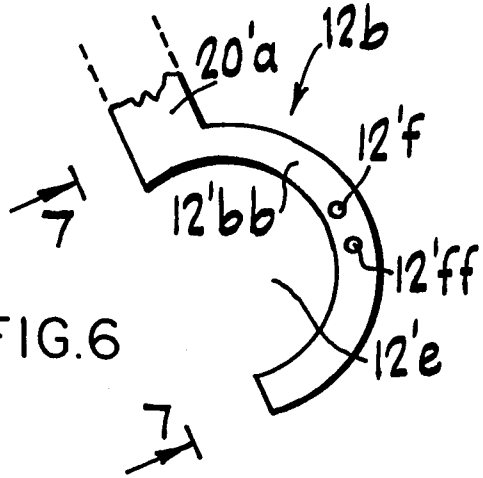
Figure 7:
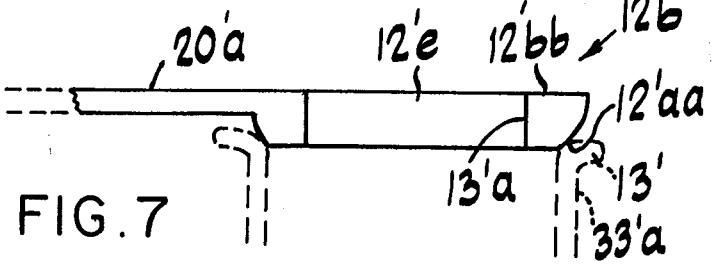

FIGS. 1 through 4 illustrate a common or same embodiment 11 of invention, emphasizing different features, and including illustration of dissolution vessel-engaging and aligning structure 12*a* while FIGS. 6 and 7 illustrate a variation thereon in an element thereof, illustrating an alternate vessel-engaging and aligning structure 12*b*. In its operating state—i.e. when the dissolution vessel-engaging and aligning structure 12*a* is in a position locking-in a dissolution vessel 13 diagrammatically illustrated in phantom, in a stable centered position relative to stirring shaft 14, dissolution vessel-engaging and aligning structure 12*a* is secured rigidly in a non-shifting position and state, to the platform 15; annular ring structure 12*bb* presses-downwardly onto typically plastic or rubber annular gasket 12*cc* (having through-space 12*e*) onto the top annular rim 13*a* of the dissolution vessel 13. Likewise, motor 16 with its rotary-drivable shaft 14 and stirring paddles or blades 17 mounted thereon, are stably centered relative to the predetermined position of a central or mid-point of inner-diameter of the dissolution vessel 13 as gauged and stably held by the dissolution vessel-engaging and aligning structure 12*a* , as a result of the motor 16 being mounted on bracket arms 18, 19 and 20 secured on and by securing structures 21, 23*a*, 23*b* and 23*c* (not shown in FIG. 1/see FIG. 2) when moved in direction 22 and locked-in, in the secured state being secured to the platform 15 or equivalent thereof. A switch 24 in appropriate circuitry 25 controls alternate activation and deactivation of the motor 16 to cause the shaft 14 to revolve, in convention electrical activation and revolving manner. The conventional gage 26 is vise-clamped into a mounting structure 26*a* that is rigidly non-shiftably locked into place by lock-screw 26*b* (see FIG. 2B) onto the annulus structure 12*bb* (or equivalent directly or indirectly-connected structure) in a predetermined precision position (at which its shaft end 27*a* is centered to press against side-face 19) such that the conventionally spring-loaded shaft 27 with its shaft-end 27*a* is biased for alternate outward and inward (to and fro) movement 27*b* when its shaft-end is aligned with and pressed against (or touching) a side-face of the shaft 19, making it possible to reliably ascertain whether or not the shaft 14 is at true-center of the inside diameter of a vessel at any and all time(s) and making it possible to test for and ascertain whether or not the shaft is warped (sprung-)—such condition being typically and conventionally referred as in a "runout" when it is bent, warped or otherwise not totally linear in nature, as ascertained during the revolving of the shaft 14. After the bracket arm 20 is slid into open space 28 as the 23*aa* slides into slot 29, the wing-nut 23*ab* in tightened down onto the surface 21*a* and thereafter the wing nuts 23*b* and 23*c* are tightened to firm-up the stable position and to the appropriate amount to precisely position the dissolution vessel-engaging (supporting) and aligning structure 12*a* in it precisely ascertained predetermined position and state at which a dissolution vessel centered thereby is positioned with the shaft 14 located precisely at a mid-point of the dissolution vessel 13 inner diameter 31 between opposite vessel inner-wall surfaces 13*a* and 13*b* of space 32 when the outer opposite flange surfaces properly align and secure the dissolution vessel 13 by pressing against the dissolution vessel opposite inner-wall surfaces 13*a* and 13*b*. A critical aspect of the present invention as regarding the always true alignment of alternate dissolution vessels from time to time, is the present invention's alignment measured from opposite inner-surfaces of the opposite vertical wall surfaces 13*a* and 13*b* of the dissolution vessel 13—because such dissolution vessel inner wall surfaces 13*a* and 13*b* are always true and exact; in contrast, outer vertical wall surfaces 33*a* and 33*b* normally and conventionally vary in the dissolution vessel's "outer" diameter—wherefore the mere platform hole formed by its inner vertical walls 34*a* and 34*b* cannot possibly reliably center a dissolution vessel by its mere pressure against outer walls 33*a* and 33*b* of a dissolution vessel 13. The downwardly-extending shaft 14 may have its forward to rearward tilt adjusted by loosening conventionally-threaded wingnut 35 on conventionally-threaded shaft 36 thereby allowing raising or lowering support arm 18 in either one or the other of alternate directions 37, as need might require in setting the initial predetermined centered position of the shaft 14 as above-discussed; after adjusting, the wingnut 35 is again tightened. It is noted that FIG. 1 illustrates the bracket arm 20 and the securing structure 20 in an exploded view, which accordingly has the bracket arm in-place within the space 28 and the threaded wingnut-shaft 23*aa* within slot 29 with the wingnut 23*ab* screwed-down in a secured position and state. Motor 24 is powered by appropriate conventional wiring circuitry 38. Optionally but preferably there is present a conventional or other desired precision chuck assembly 16*a* that mounts the downwardly-extending paddle shaft 14 to the driving motor M designated 16.

Figure 2A:
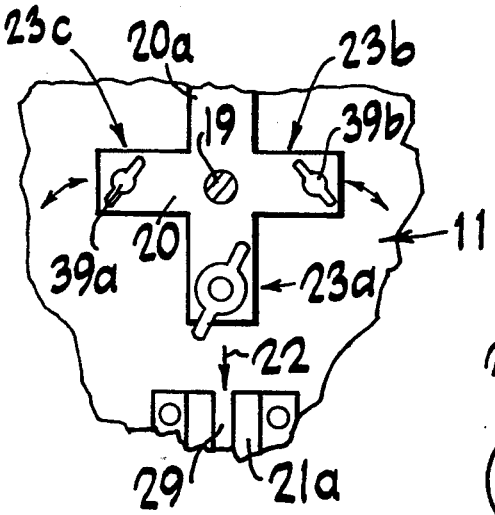

FIG. 2A illustrates the bracket arm 20 showing the bracket arm 19 in cross-section, and showing the two laterally-extending side bracket arms 23*b* and 23*c* with their respective screw-down adjustment screws 39*a* and 39*b*, by which tilt of the downwardly-extending stirring-shaft 14 may be tilted or adjusted in tilt in either of one or the other lateral directions—as well as it being possible to slightly modify forward and/or rearward tilt of the downwardly-extending stirring-shaft 14 by adjustment amounts upwardly or downwardly of screw-down of both of the adjustment screws 39*a* and 39*b*.

Figure 2B:
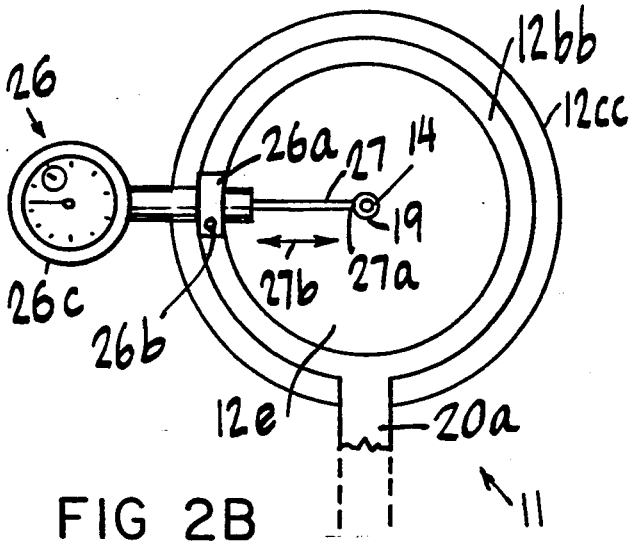

FIG. 2B illustrates the portion shown in FIG. 1 of the dissolution vessel engaging (supporting) and aligning structure 12*a* to the extent not shown in FIG. 2A, in the top view thereof as taken along line 2B—2B of FIG. 1. Also, there is better shown the overlapping of the annulus aligning structure 12*bb* holding-down the gasket 12*cc*, and mounting the gauge support 26*a* of the gauge 26, including the arm 20*a* (shown in-part). FIG. 2B also better illustrates the annulus through-space hole 12 of the annulus structure 12*bb*. It is noted that it is not essential that the annulus extend all of the way around, being merely critical that at-least two opposite surfaces 12*aa* and 12*ab* exist as identified in FIG. 1, and that the gage 26 be mounted thereon at some location, i.e. it need not be a complete annulus—a semi-circle or squared or right-angular structure (not illustrated) being obvious equivalents that would function adequately, although preferred results are obtained by the illustrated annulus (or functionally-equivalent FIGS. 6 and 7 semicircular or FIG. 8 squared) structure illustrated.

Figure 3:
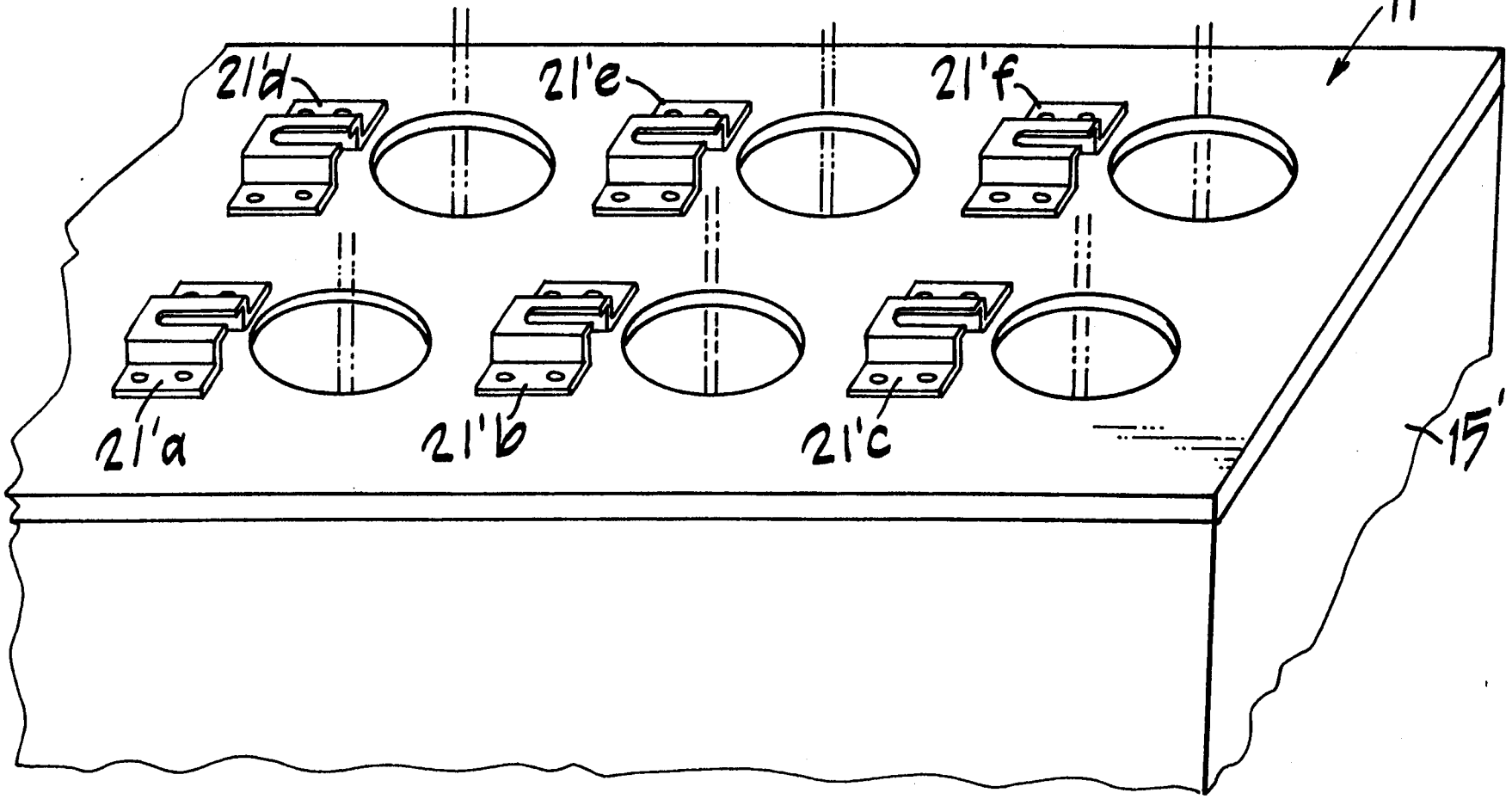

FIG. 3 illustrates an enlarged view of the counter or platform of the type illustrated in the embodiment 11 of FIGS. 1, 2A and 2B, illustrating typical diagrammatic appearance thereof where there are provided multiple separate holes (i.e. a plurality) of sized holes each for loosely supporting a dissolution vessel therein and on which counter a total set of structures described for FIGS. 1, 2A and 2B are mountable for separate operation.

Figure 4:
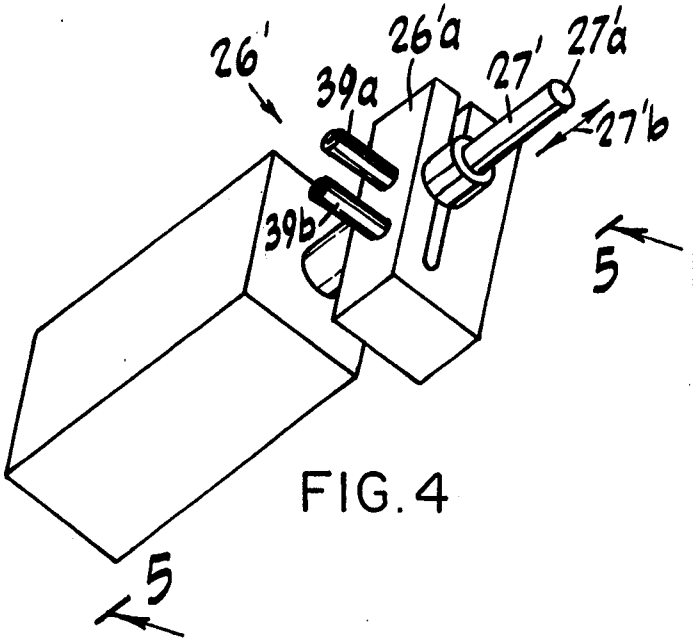

FIG. 4 illustrates more fully the inventive gauge combination 26' shown in and described for above-described Figures. In this embodiment, the same features previously described are also herein described. Additionally illustrated for this inventive embodiment are the mounting spaced-apart prongs 39*a* and 39*b* of the gauge support 26'*a* within prong-receiving holes of the annulus structure 12*bb* of FIGS. 1, 2A and 2B and the semicircular structure of FIGS. 6 and 7 described-below, for the mounting for non-shifting rigid support of the overall gauge combination 26' of FIGS. 4 and 5 and gauge combination 26 of FIGS. 1, 2A and 2B.

Figure 5:
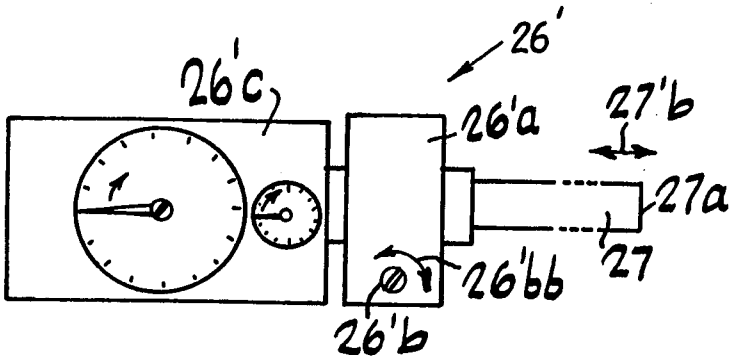

FIG. 5 as taken along lines 5—5 of FIG. 4 illustrates additionally illustrating the opposite directions of movement of the locking screw 26'*b* as alternate directions 26'*bb* for locking-in or loosening (freeing) the conventional gauge portion 26*c* of the gauge combination 26'.

FIG. 6 illustrates an alternate equivalent embodiment to that shown FIG. 1 and 2B, this embodiment being substantially semicircular in shape. There is additionally illustrated the feature also in common with but not illustrated for the embodiment of FIGS. 1, 2A and 2B, of the presence of precision-positioned spaced-apart mounting-holes 12'*f* and 12'*ff* into which the gauge combination mounting-prongs 39*a* and 39*b* described-above for FIG. 4.

With regard to the inventive gauge combination 26 and 26' illustrated in FIGS. 1, 2B, 4, 5, and 6, paddle or basket shaft wobble, technically called "runout" can have a major detrimental effect on efforts to secure consistent and reliable dissolution results for matter being dissolved by stirring or agitation within liquid contained in a dissolution vessel. Excessive runout result typically from shafts that are not straight. Often invisible to the naked eye, small bends can result from improper shipping, storage, or faulty or defective manufacturing techniques and/or apparatus. Until now, machine shop runout gauges have been used to detect and measure wobble on dissolution paddle and basket shafts. Unfortunately, prior to the present inventive combination mounted or adapted to be mounted in a predetermined fixed and centered relationship with a position into which a dissolution vessel is alignable, the prior gauges and use thereof have been cumbersome and difficult to use with any ascertainable reliability in precision and repeatable results, to an extent that use thereof for checking runout has actually discouraged users of dissolution equipment from desired checking and rechecking to ascertain reliable and consistent dissolution results. The present inventive gauge combination alone and as well in combination use with the dissolution vessel centering embodiments of this invention serve to effect or obtain self-aligning and requir(s) no tools for use. Accordingly, by the present invention and embodiments thereof, the checking of potential runout is made both easy and fully reliable, making frequent checking easy and not a forbidding nor grueling task.

FIG. 7 illustrates a view of the embodiment of FIG. 6 as taken along lines 7—7 of FIG. 6. In the embodiment of FIGS. 6 and 7, this FIG. 7 illustrates the slanted shape of the outer-diameter portion of the semi-annular structure 12'*bb*, identified as 12'*aa* serve the purpose of both centering the dissolution vessel 13, as well as the function of pressing downwardly against the dissolution vessel 13' to thereby secure the vessel 13' against any potential wobbling or shifting movement, and likewise may be utilized as an equivalent structure in the illustrated embodiment of FIGS. 1, 2A and 2B for centering and downwardly-pressing and securing the dissolution vessel 13.

In operation of the embodiments of above-described Figures, the dissolution vessel is placed into the platform hole of a size that the hole-forming structure loosely-supports the dissolution vessel, prior to the lowering of the downwardly-extending shaft and its associated paddle into a stirring or agitating position, and prior to attaining the centering of the dissolution vessel.

Figure 8A:
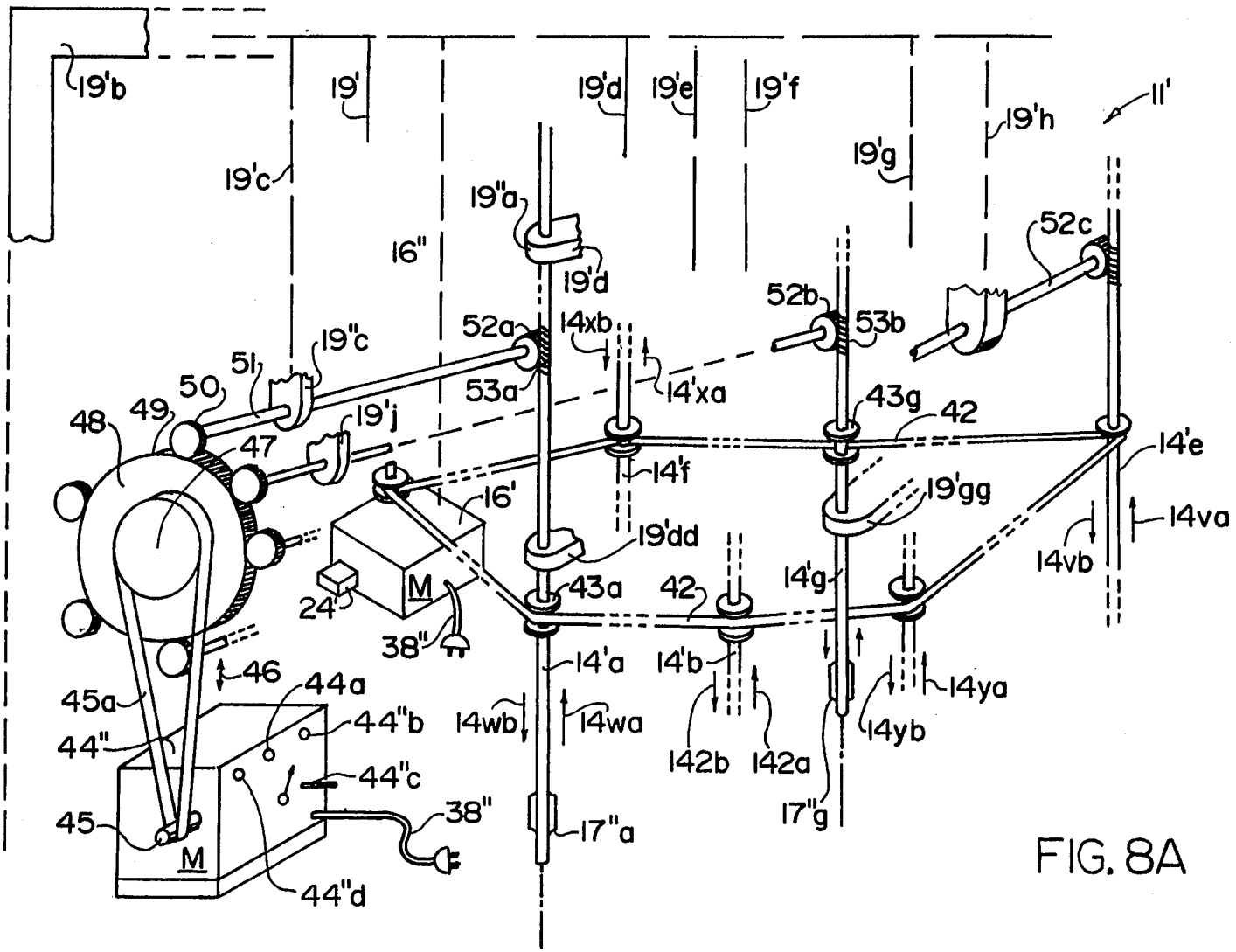
Figure 8B:
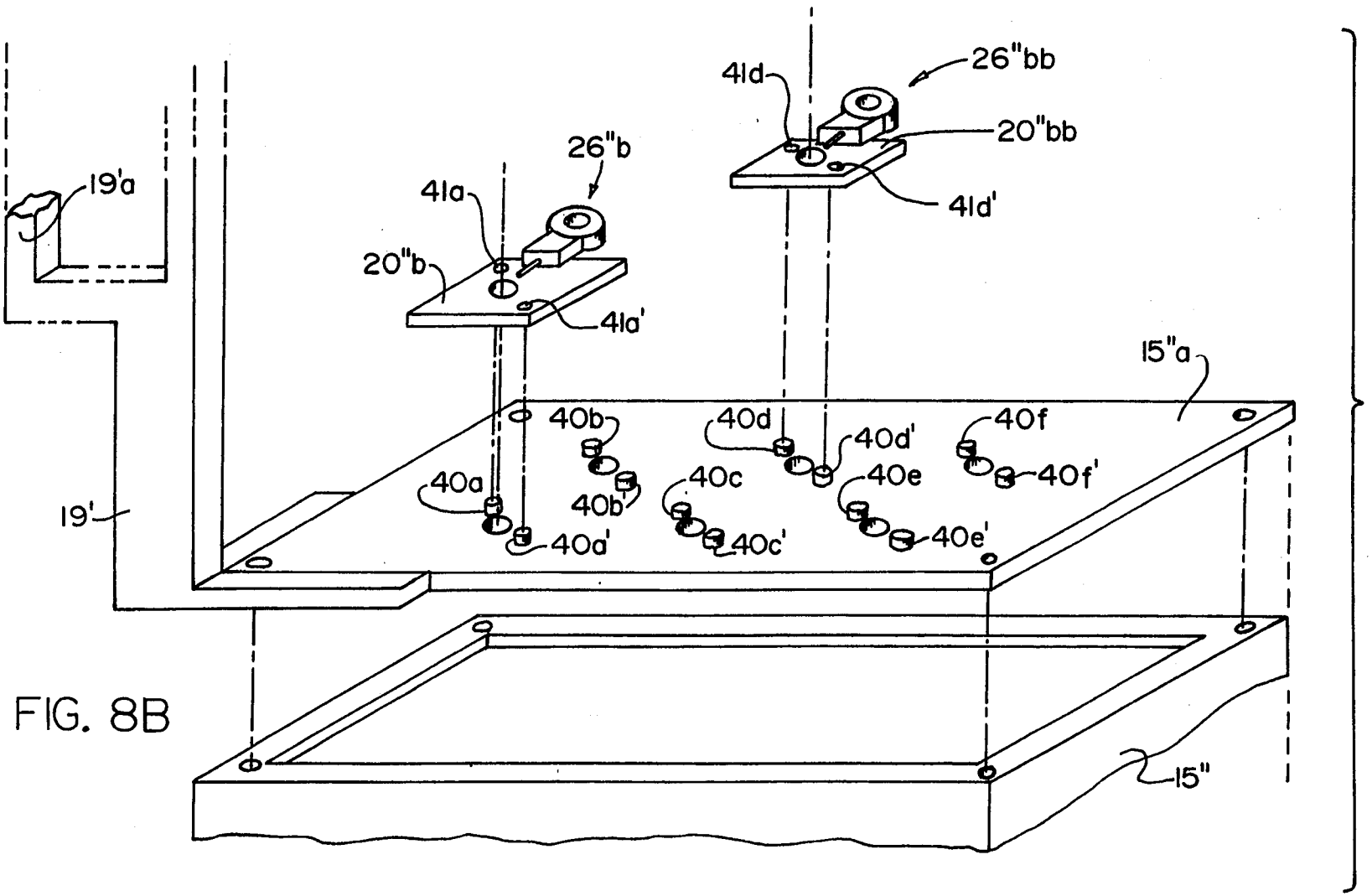

FIGS. 8A and 8B illustrate an alternate and preferred embodiment 11' embodying the same functional features described-above for prior embodiment, together with additional and preferred features and functions of this embodiment, as follow. In this embodiment 11' there are a plurality of downwardly-extending paddle-shafts 14'*a*, 14'*b*, 14'*c*, 14'*d*, 14'*e*, 14'*f*, etc., likewise precision-aligned to be in precision central alignment with dissolution vessels when such dissolution vessels are centered by the preset accurate and precision aligning structures 20''*b*, 20''*bb*, etc. and the mounted gauge combinations 26''*b*, 26''*bb*, etc.—with the precision aligning structures 20''*b* etc. When mounted corresponding in alignment to aforestated downwardly-extending paddle shafts 14'*a*, etc. The precision aligning structures 20''*b* etc. each are mounted on their respective aligning male-peg members 40*a* and 40*a'* through 40*f* and 40*f'* which male-peg members are precision-tooled to slidably fit into precision-drilled peg-receiving apertures or female receptacles 41*a* and 41*a'*, 41*d* and 41*d'*, etc., corresponding in the positioning thereof When mounted on the male-peg members, to their respectively-matched downwardly-extending paddle shafts 14'*a*, 14'*g*, etc. respectively, the driving motor 16' being supported by support arm 16'' extending from support arm 19'*b*. The aligning male-peg members are precision-mounted in precision drilled holes or the like made in predetermined precise locations in the platform plate 20''*a*, positioned such that the aligning squared members 2'*b*, 20''*bb*, etc. when mounted on the respective aligning male-peg member, will result in the dissolution vessels becoming automatically centrally aligned with their respectively positioned downwardly-extending paddle shafts 14'a, 14'g, etc. by alignment functioning of the aligning squared member, having structures substantially corresponding to that of above-discussed annular aligning member 12'a, in accord with illustrations of below-discussed FIGS. 9A-1, 9B-1 and 9B-2. Although there are obvious mechanically equivalent arrangements, the plurality of downwardly-extending paddle shafts 14'a, 14'g, etc. are commonly driven by a single driving motor 16' through an appropriate driving belt and driven revolvable belt-channeling members 43a, 43g, etc. As aforestated, the downwardly-extending shafts are supported by interconnected support arms such as 19'd, 19'dd etc. In this embodiment, the plurality of downwardly-extending paddle shaft 14'a, 14'g, etc. are commonly and simultaneously adapted to be concurrently alternately raised and lowered to and from stirring positions within centered dissolution vessels. In this particular illustrated embodiment, this is typically accomplished by ratchet engagements of toothed gears 52a, 52b, etc. engaged with and drivable of ratchet teeth 53a, 53b, etc. of the above-noted respective downwardly-extending paddle shafts. The gears such as gear 52a' are driven by revolvable shafts such as shaft 5a that is revolvably driven by revolvable teeth 50 driven by engaging teeth 49 that are capable of driving multiple other toothed gears by toothed gear 48 driven by rigidly integral large belt-gear 47 driven by belt 45a from small belt-gear shaft 45 driven by Motor 44'' having controls for neutral position 44''a, upward-drive position 44''b and downward-drive position 44''c for alternately raising and lowering the downwardly-extending plurality of paddle shafts. The support shaft 19' that supports the afore-stated raising and lowering structures and supports therefor and mechanisms thereof, are supportingly mounted on and rigidly attached to the platform plate 20''a establishing and maintaining proper alignment of the shafts with the plate holes and with the dissolution vessels once centered by the aligning members 20''b, etc. The platform plate 20''a is secured by bolts, screws or the like to any appropriate table-like or stand support 15'' in the nature of that illustrated.

Figures 1, 9A:
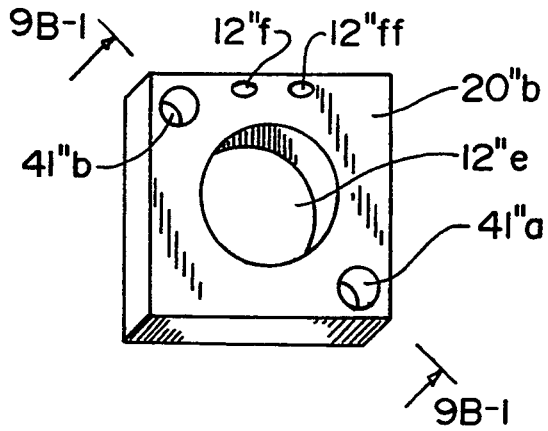
Figures 1, 9B:
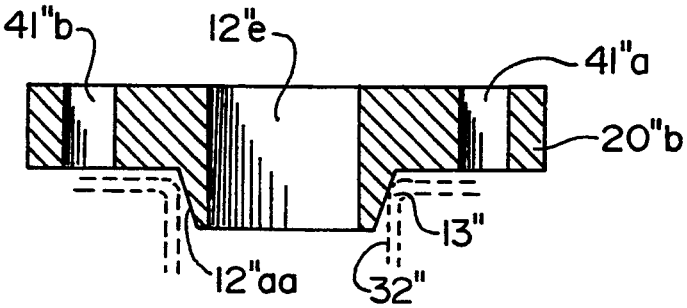
Figures 2, 9B:
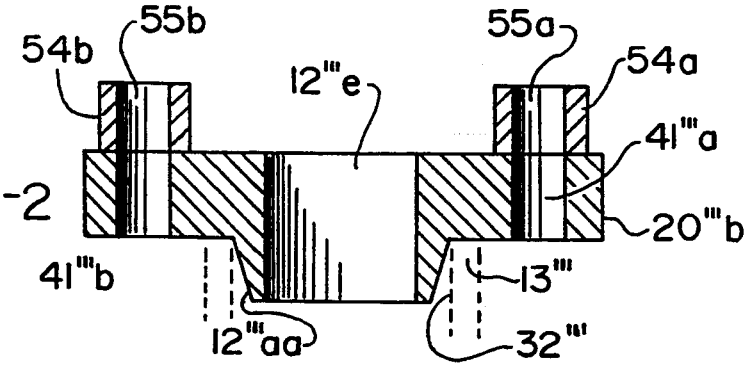
Figures 2, 9A:
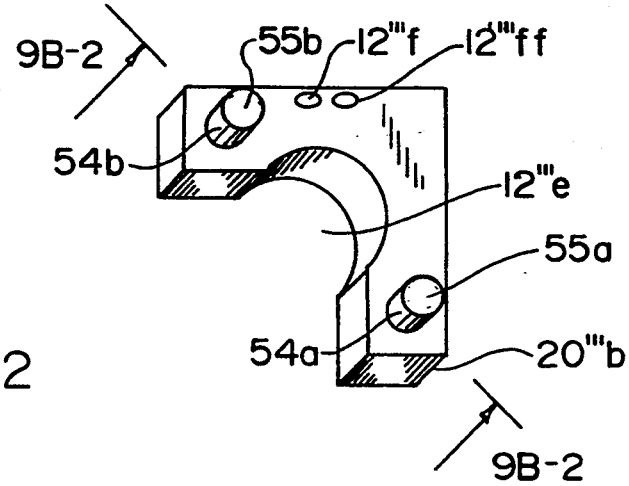

FIGS. 9A-1 and 9B-1 illustrate the squared aligning member 20''b of FIGS. 8A and 8B, illustrating the same features discussed relative thereto in the FIGS. 8A and 8B. The FIG. 9B-1 illustrates the slanted aligning surfaces 12aa serving to both centrally align and press downwardly on to thereby anchor or secure the dissolution vessel 13'' by pressing radially outwardly on the inner surface 32'' and downwardly on the top edge of the dissolution vessel 13''. While the thickness of the aligning member 20''b of FIGS. 9A-1 and 9B-1 may be varied up to preferably sufficient thickness to add non-shifting upwardly, downwardly and/or laterally of the aligning structure 20''b, to improve stability and sturdiness slippage or shifting in the slip-on mating relationship to the male-peg members such as the FIGS. 8A and 8B peg members 40a and 40a', FIGS. 9A-2 and 9B-2 illustrate a variation in two aspects. The aligning member 20'''b is not required to be a complete square—see Fig. 9A-2, and there are a rigidly continuous additional member 54a and 54b that add stabilizing effective length of the channel space 41'''a and 41'''b by the continuing channel 55a and 55b, reducing the possibility and probability of upward or downward and/or lateral shifting of the aligning member 20'''. As with foregoing other embodiment, preferably the inventive gauge combination is detachably mountable on the aligning member 20'''b as illustrated by female peg or prong-receiving holes 12'''f and 12'''ff the same as illustrated for each of FIGS. 9A-1 and 6, also applying to each and all other illustrated and contemplated embodiments, although it is possible to have a separate permanently mounted gauge combination for each downwardly-extending paddle-shaft position. The intermittently removable nature permits financial economizing by merely shifting the mounting thereof from one position to any other of the plurality of positions intermittently whenever desired to check wobble.

Figure 10:
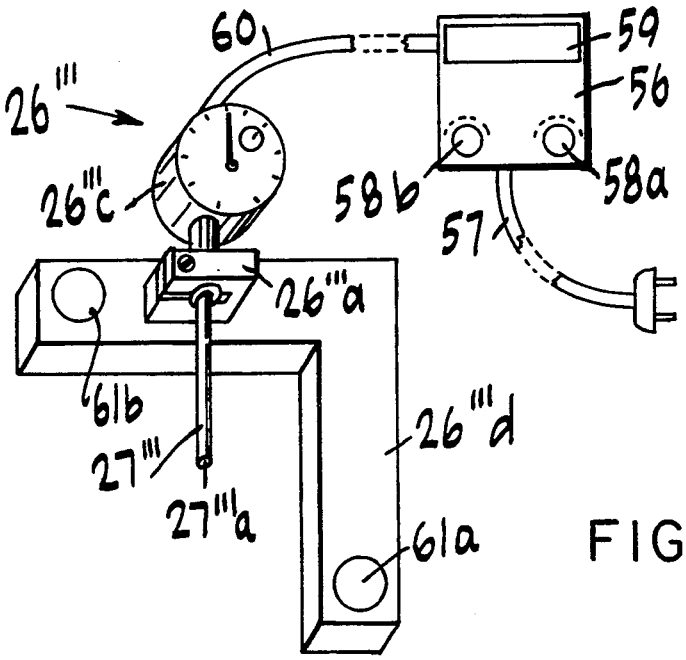

FIG. 10 illustrates a further improved and greater gauge combination inclusive of a mounting support 26'''d having female-formed typically columnar through-spaces of a predetermined size to mount on either or both the FIG. 9B-2 members 54a and 54b and/or the FIGS. 8A and 8B peg-members 40a and 40a'. Also as a further improvement, utilizing convention electronic and computer technology already known, the signals registered by the gauge 26'''c is transmitted through appropriate conventional signal-conveying connector or bus to computer 56 powered by oonventional power source 57 and displayed by any conventional means inclusive of any one or more video screen or continuous moving or rolling pen-chart designated 59, with conventional control buttons (and the like) 58a and 58b.

Figure 11:
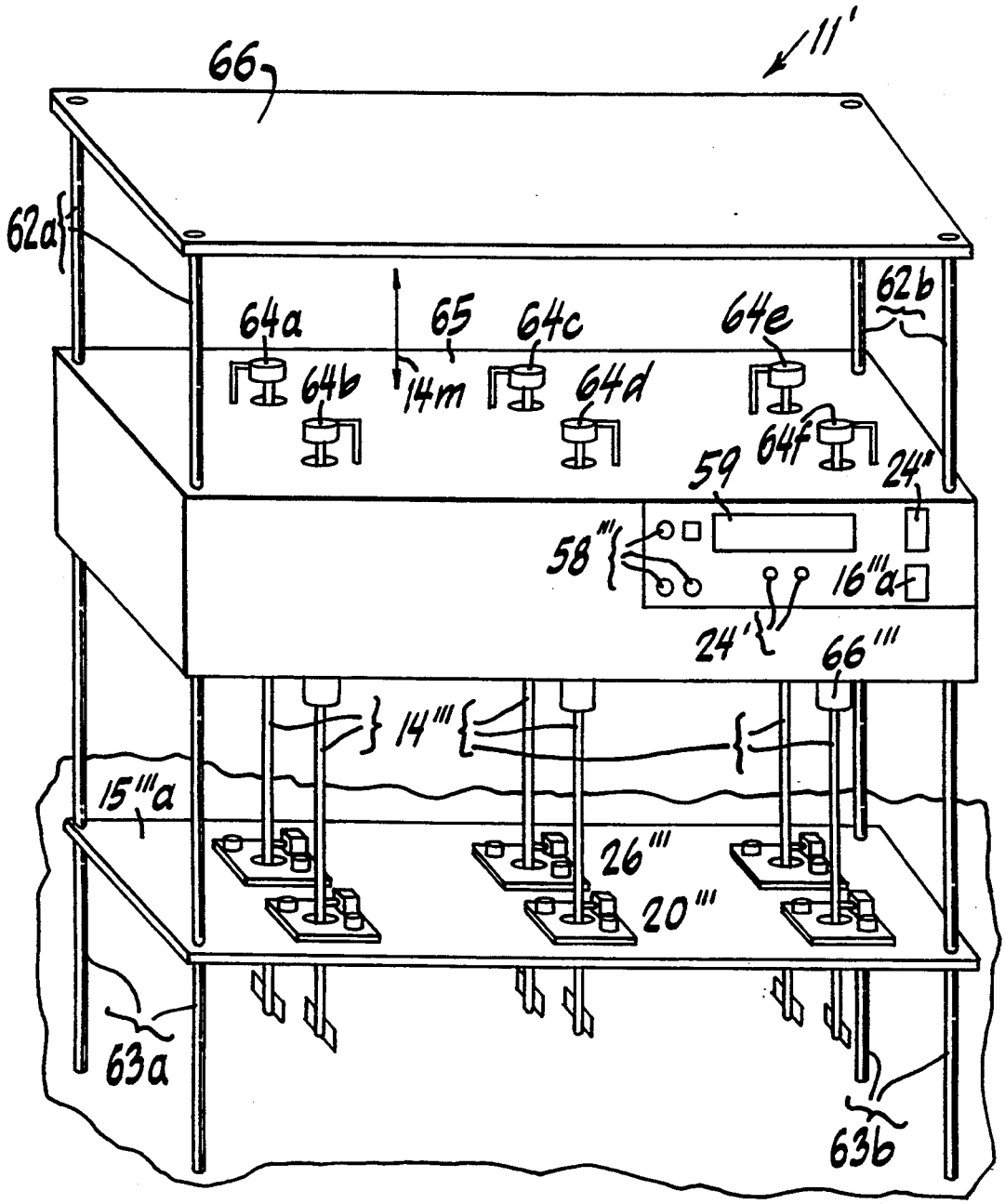

As contrasted to the FIGS. 8A and 8B embodiment, it is apparent that within ordinary skill equivalents for raising and lowering the entire upper support structure that support the aligned plurality of downwardly-extending shafts, may be by way of raising and lowering alternately the entire support structure by other arrangement, and that alternatively to a common drive, there may be separate drive motors of the nature of that of FIG. 1, to have a separate drive motor for each downwardly-extending paddle shaft. Also, in actual commercial practice, the separately shown computer or other digital readouts or the like and/or monitored motorized vertical adjustment, and other conventional features such as adjustable potentiometer and fingertip clutch control, and adjustable upper and/or lower limits of raising and/or lowering the downwardly-extending shafts, and veralous control switches, may be in a common indistinguishable cabinet, as opposed to prior illustration showing the distinctly separate motors, computer, etc. Such typical appearance factually is shown in FIG. 11, as the actual commercial model closely resembles.

Accordingly, by a corresponding ratchet and gear means and drive therefor, comparable to that of FIGS. 8A and 8B, the entire electronic and drive and controls unit 65 is intermittently movable upwardly to simultaneously raise all downwardly-extending the presently shown lowered position, and for alternately thereafter lowering the same, by virtue of controls such as 24' and 24'', ridable on upright rods 62a and 62b which are supported by upper support plate 66; digital readout screen is a part of the electronics of above-noted unit 65, all constituting conventional technology apart from matters previously identified in former disclosure description. Directions of upward and downward movements are indicated by arrows 14m, for the entire unit 65. For each of the drives of the downwardly-extending paddle shafts 14''', there are the respective fingertip clutch controls 64a, through 64f—all constituting conventional technology. The platform plate 15'''a is typically about ⅜ inch thick aluminum base plate having therein (not shown) conventional holes the same as illustrated as for prior embodiments, in which the previously illustrated and described dissolution vessels (not shown in this illustration) loosely are mounted, over which the the plurality of support and aligning members 20''' and the gauge combination 26''' mounted thereon, are mounted as shown herein—the same as illustrated for the FIGS. 8A and 8B embodiment. The entire embodiment is supported by its downwardly-extending legs **63*a* and 63*b*. Each of the downwardly-extending paddle-shafts is mounted in a precision chuck assembly 66''', conventional art previously discussed above. The upright rods 62*a* and 62*b* and the legs 63*a* and 63*b* are continuous typically stainless steel posts. The conventional paddles are typically stainless steel teflon coated paddles. A typical dissolution vessel is a 1000 ml round bottom glass vessel or plastic vessel. The conventional above-discussed gauges a part of the gage combination, are typically of stainless steel; likewise for the gauge support 26*a*, 26'*a***, etc. of various above-discussed embodiments.

It is within the scope of the present invention to make such variations and modifications and substitution of equivalents to the extent obvious to a person of ordinary skill in this art.

I claim:

1. A tablet dissolution vessel centering device comprising in combination: dissolution-vessel support and aligning guide means for loosely supporting an outer surface and for aligning inside diameter surfaces of a dissolution vessel having an upper opening with a center of the dissolution vessel supported and the upper opening in a centered state and position of exact alignment with a predetermined fixed-position for maintaining of a downwardly-extending lineally-extending stirrer-paddle shaft on which during dissolution at-least one stirrer paddle is mounted on a lower end thereof for stirring matter dissolvable in liquid contained during matter dissolution in the dissolution vessel; stirring means for stirring liquid contained in the dissolution vessel during operational use thereof, the stirring means including said downwardly-extending lineally-extending stirrer-paddle shaft and at-least one stirrer paddle; stirring means support structure adapted to provide support to maintain said stirring means in said centered state of exact alignment as a predetermined fixed stirring position; stirrer anchoring moans for mounting said stirring means support structure in said predetermined fixed stirring position such that said center of the dissolution vessel is always in said centered state and position in exact initial alignment with a fixed-position of the downwardly-extending stirrer-paddle shaft of the stirring means; and said dissolution-vessel support and aligning guide moans including dissolution vessel locking means including locking structure positioned to support said dissolution vessel in said centered state and position of said exact initial alignment when said inner diameter surfaces of said dissolution vessel are supported against said support and aligning guide means in a state of being aligned against inside diameter surfaces of the dissolution vessel, said dissolution-vessel support and aligning guide means including downwardly-extending spaced-apart rigid members extending downwardly from said predetermined outer-diameter spaced-apart surfaces, said downwardly-extending spaced-apart rigid members having predetermined outer-diameter spaced-apart surfaces relative to said vessel-mouth annular member, said downwardly-extending spaced apart rigid members being positioned at said predetermined outer-diameter spaced-apart surfaces such that said spaced-apart surfaces will concurrently fit against spaced-apart inside-diameter surfaces of a mouth of a dissolution vessel supported by said dissolution vessel support structure and such that said dissolution vessel becomes centrally aligned with downwardly-extending stirrer-paddle shaft and maintained thereat with the downwardly-extending spaced-apart rigid members pressed against said inside-diameter surfaces; and stirring shaft alignment-tester mounting means for stably and non-shiftingly mounting at-least one of support structure and locking structure for a dissolution vessel, a stirring shaft alignment-tester in said predetermined fixed stirring position such that said stirring shaft alignment-tester is adapted to establish exact location of said downwardly-extending lineally-extending stirrer-paddle shaft with said downwardly-extending lineally-extending stirrer-paddle shaft positioned to be in substantially central alignment with the center of the vessel-mouth annular member for and including inside diameter surfaces of the vessel-mouth annular member with the dissolution vessel having said inside diameter surfaces positioned such that a center of the dissolution vessel's inner diameter is centered for initial exact alignment with said predetermined fixed-position, said stirring shaft alignment-tester mounting means including receiving and tester-locking structure adapted to intermittently receive and lock and alternately to intermittently unlock and release said stirring shaft alignment-tester, between stirring operations; said dissolution-vessel support and aligning guide means and said anchoring means including common mounting structure providing for predetermined fixed spacial and positioning relationships of one to the other thereof; and including said dissolution vessel with the dissolution vessel having an upper mouth having outer circumscribing surfaces, and said dissolution vessel locking means including intermittently lockable and releasable fastening structures spaced-apart from one-another in predetermined fastening positions on said dissolution vessel support structure positioned around said upper mouth and outer circumscribing surfaces thereof with said dissolution vessel supported against said aligning and holding means, whereby the fastening structures may be locked after mounting a dissolution vessel and unlocked before removal of a mounted dissolution vessel.

2. The tablet dissolution vessel centering device of claim 1, in which said dissolution-vessel support and aligning guide means includes a vessel-mouth annular member, said vessel-mouth annular member having predetermined outer-diameter spaced-apart locations and including downwardly-extending spaced-apart rigid members extending downwardly from said predetermined outer-diameter spaced-apart locations, said downwardly-extending spaced-apart rigid members having predetermined outer-diameter spaced-apart surfaces relative to said vessel-mouth annular member, said downwardly-extending spaced-apart rigid members being positioned at said predetermined outer-diameter spaced-apart locations such that said spaced-apart surfaces will concurrently fit against spaced-apart inside-diameter surfaces of a mouth of a dissolution vessel when supported by said dissolution vessel support structure and such that said dissolution vessel becomes centrally aligned with downwardly-extending stirrer-paddle shaft and maintained thereat when the vessel-mouth annular member is being pressed against said inside-diameter surfaces.

3. The tablet dissolution vessel centering device of claim 1, in which said stirring means support structure is adjustably adaptable such that said stirring support structure additionally is adapted to provide for said stirring means to be at-least one of a) initially positioned to establish before a stirring operation and b) subsequently repositioned to reestablish subsequent to a stirring operation said downwardly-extending lineally-extending stirrer-paddle shaft to said predetermined fixed stirring position to a centered location between opposite said inner diameter surfaces of said dissolution vessel when the dissolution vessel is upwardly supported against said dissolution-vessel support and aligning means.

4. A tablet dissolution vessel centering device comprising in combination: dissolution-vessel support and aligning guide means for loosely supporting an outer surface and for aligning inside diameter surfaces of a dissolution vessel having an upper opening with a center of the dissolution vessel supported and the upper opening in a centered state and position of exact alignment with a predetermined fixed-position for maintaining of a downwardly-extending lineally-extending stirrer-paddle shaft on which during dissolution at-least one stirrer paddle is mounted on a lower end thereof for stirring matter dissolvable in liquid contained during matter dissolution in the dissolution vessel; stirring means for stirring liquid contained in the dissolution vessel during operational use thereof, the stirring means including said downwardly-extending lineally-extending stirrer-paddle shaft and at-least one stirrer paddle; stirring means support structure adapted to provide support to maintain said stirring means in said centered state of exact alignment as a predetermined fixed stirring position; stirrer anchoring means for mounting said stirring means support structure in said predetermined fixed stirring position such that said center of the dissolution vessel is always in said centered state and position in exact initial alignment with a fixed-position of the downwardly-extending stirrer-paddle shaft of the stirring means; and said dissolution-vessel support and aligning guide means including dissolution vessel locking means including locking structure positioned to support said dissolution vessel in said centered state and position of said exact initial alignment when said inner diameter surfaces of said dissolution vessel are upwardly supported against said support and aligning guide means in a state of being aligned against inside diameter surfaces of the dissolution vessel, said dissolution-vessel support and aligning means including a platform structure having hole-forming structure forming at-least one dissolution vessel-receiving space through said platform structure, the dissolution vessel-receiving space being of a size sufficiently to loosely support an outwardly extending flange of a dissolution vessel within said dissolution vessel-receiving space.

5. A tablet dissolution vessel centering device comprising in combination: dissolution-vessel support and aligning guide means for loosely supporting an outer surface and for aligning inside diameter surfaces of a dissolution vessel having an upper opening with a center of the dissolution vessel supported and the upper opening in a centered state and position of exact alignment with a predetermined fixed-position for maintaining of a downwardly-extending lineally-extending stirrer-paddle shaft on which during dissolution at-least one stirrer paddle is mounted on a lower end thereof for stirring matter dissolvable in liquid contained during matter dissolution in the dissolution vessel; stirring means for stirring liquid contained in the dissolution vessel during operational use thereof, the stirring means including said downwardly-extending lineally-extending stirrer-paddle shaft and at-least one stirrer paddle; stirring means support structure adapted to provide support to maintain said stirring means in said centered state of exact alignment as a predetermined fixed stirring position; stirrer anchoring means for mounting said stirring means support structure in said predetermined fixed stirring position such that said center of the dissolution vessel is always in said centered state and position in exact initial alignment with a fixed-position of the downwardly-extending stirrer-paddle shaft of the stirring means; and said dissolution-vessel support and aligning guide means including dissolution vessel locking means including locking structure positioned to support said dissolution vessel in said centered state and position of said exact initial alignment when said inner diameter surfaces of said dissolution vessel are supported against said support and aligning guide means in a state of being aligned against inside diameter surfaces of the dissolution vessel, said stirring means support structure being adjustably adaptable such that said stirring support structure additionally is adapted to provide for said stirring means to be at-least one of a) initially positioned to establish before a stirring operation and b) subsequently reposition to reestablish after a stirring operation said downwardly-extending lineally-extending stirrer-paddle shaft to said predetermined fixed stirring position at a centered location between opposite said inner diameter surfaces of said dissolution vessel with the dissolution vessel supported against said support aligning means.

6. A tablet dissolution vessel centering device comprising in combination: dissolution-vessel support and aligning guide means for loosely supporting an outer surface and for aligning inside diameter surfaces of a dissolution vessel having an upper opening with a center of the dissolution vessel supported and the upper opening in a centered state and position of exact alignment with a predetermined fixed-position for maintaining of a downwardly-extending lineally-extending stirrer-paddle shaft on which during dissolution at-least one stirrer paddle is mounted on a lower end thereof for stirring matter dissolvable in liquid contained during matter dissolution in the dissolution vessel; stirring means for stirring liquid contained in the dissolution vessel during operational use thereof, the stirring means including said downwardly-extending lineally-extending stirrer-paddle shaft and at-least one stirrer paddle; stirring means support structure adapted to provide support to maintain said stirring means in said centered state of exact alignment as a predetermined fixed stirring position; stirrer anchoring means for mounting said stirring means support structure in said predetermined fixed stirring position such that said center of the dissolution vessel is always in said centered state and positioned in exact initial alignment with a fixed-position of the downwardly-extending stirrer-paddle shaft of the stirring means; and said dissolution-vessel support and aligning guide means including dissolution vessel locking means including locking structure positioned to support said dissolution vessel in said centered state and position of said exact initial alignment when said inner diameter surfaces of said dissolution vessel are supported against said support and aligning guide means in a state of being aligned against inside diameter surfaces of the dissolution vessel, said dissolution-vessel support and aligning guide means including a vessel-mouth annular member, said vessel-mouth annular member having predetermined outer-diameter spaced-apart locations and including downwardly-extending spaced-apart rigid members extending downwardly from said predetermined outer-diameter spaced-apart locations, said downwardly-extending spaced-apart rigid members having predetermined outer-diameter spaced-apart surfaces relative to said vessel-mouth annular member, said downwardly-extending spaced-apart rigid members being positioned at said predetermined outer-diameter spaced-apart locations such that said spaced-apart surfaces will concurrently fit against spaced-apart inside-diameter surfaces of a mouth of a dissolution vessel when supported by said dissolution vessel support structure and such that said dissolution vessel becomes centrally aligned with downwardly-extending stirrer-paddle shaft and maintained thereat when the vessel-mouth annular member is being pressed against said inside-diameter surfaces, said vessel-mouth annular member having predetermined outer-diameter spaced-apart locations and including downwardly-extending spaced-apart rigid members extending downwardly from said predetermined outer-diameter spaced-apart locations, said downwardly-extending spaced-apart rigid members having predetermined outer-diameter spaced-apart surfaces relative to said vessel-mouth annular member, said downwardly-extending spaced-apart rigid members being positioned at said predetermined outer-diameter spaced-apart locations such that said spaced-apart surfaces will concurrently fit against spaced-apart inside-diameter vessel support structure and such that said dissolution vessel becomes centrally aligned with downwardly-extending stirrer-paddle shaft and maintained thereat when the vessel-mouth annular member is being pressed against said inside-diameter surfaces, and including stirring shaft alignment-tester mounting means for stably and non-shiftingly mounting on support structure or locking structure for a dissolution vessel, a stirring shaft alignment-tester in said predetermined fixed stirring position such that said stirring shaft alignment-tester is adapted to establish exact location of said downwardly-extending lineally-extending stirrer-paddle shaft when said downwardly-extending lineally-extending stirrer-paddle shaft is positioned to be in substantially central alignment with the center of the vessel-mouth annular member for including said inside diameter surfaces when the dissolution vessel has inside diameter surfaces thereof positioned such that a center of the dissolution vessel's inner diameter is centered for initial exact alignment with said predetermined fixed-position.

7. The tablet dissolution vessel centering device of claim 6, in which said stirring shaft alignment-tester mounting means includes receiving and tester-locking structure adapted to intermittently receive and lock and alternately to intermittently unlock and release said stirring shaft alignment-tester, between stirring operations.

8. The tablet dissolution vessel centering device of claim 7, in which said dissolution-vessel support and aligning guide means and said anchoring means include common mounting structure providing for predetermined fixed spacial and positioning relationships of one to the other thereof.

9. A tablet dissolution vessel centering device comprising in combination: dissolution-vessel support and aligning guide means for loosely supporting an outer surface and for aligning inside diameter surfaces of a dissolution vessel having an upper opening with a center of the dissolution vessel supported and the upper opening in a centered state and position of exact alignment with a predetermined fixed-position for maintaining of a downwardly-extending lineally-extending stirrer-paddle shaft on which during dissolution at-least one stirrer paddle is mounted on a lower end thereof for stirring matter dissolvable in liquid contained during matter dissolution in the dissolution vessel; stirring means for stirring liquid contained in the dissolution vessel during operational use thereof, the stirring means including said downwardly-extending lineally-extending stirrer-paddle shaft and at-least one stirrer paddle; stirring means support structure adapted to provide support to maintain said stirring means in said centered state of exact alignment as a predetermined fixed stirring position; stirrer anchoring means for mounting said stirring means support structure in said predetermined fixed stirring position such that said center of the dissolution vessel is always in said centered state and position in exact initial alignment with a fixed-position of the downwardly-extending stirrer-paddle shaft of the stirring means; and said dissolution-vessel support and aligning guide means including dissolution vessel locking means including locking structure positioned to support said dissolution vessel in said centered state and position of said exact initial alignment when said inner diameter surfaces of said dissolution vessel are supported against said support and aligning guide means in a state of being aligned against inside diameter surfaces of the dissolution vessel, and including stirring shaft alignment-tester mounting means for stably and non-shiftingly mounting on support structure or locking structure for a dissolution vessel, a stirring shaft alignment-tester in said predetermined fixed stirring position such that said stirring shaft alignment-tester is adapted to establish exact location of said downwardly-extending lineally-extending stirrer-paddle shaft when said downwardly-extending lineally-extending stirrer-paddle shaft is positioned to be in substantially central alignment with the center of the vessel-mouth annular member for and including inside diameter surfaces when the dissolution vessel has inside diameter surfaces thereof positioned such that a center of the dissolution vessel's inner diameter is centered for initial exact alignment with said predetermined fixed-position.

10. The tablet dissolution vessel centering device of claim 9, in which said stirring shaft alignment-tester mounting means is structured for intermittently receiving and locking and for intermittently unlocking and removing said stirring shaft alignment-tester.

11. A tablet dissolution vessel centering device comprising in combination: dissolution-vessel support and aligning guide means for loosely supporting an outer surface and for aligning inside diameter surfaces of a dissolution vessel having an upper opening with a center of the dissolution vessel supported and the upper opening in a centered state and position of exact alignment with a predetermined fixed-position for maintaining of a downwardly-extending lineally-extending stirrer-paddle shaft on which during dissolution at-least one stirrer paddle is mounted on a lower end thereof for stirring matter dissolvable in liquid contained during matter dissolution in the dissolution vessel; stirring means for stirring liquid contained in the dissolution vessel during operational use thereof, the stirring means including said downwardly-extending lineally-extending stirrer-paddle shaft and at-least one stirrer paddle; stirring means support structure adapted to provide support to maintain said stirring means in said centered state of exact alignment as a predetermined fixed stirring position; stirrer anchoring means for mounting said stirring means support structure in said predetermined fixed stirring position such that said center of the dissolution vessel is always in said centered state and position in exact initial alignment with a fixed-position of the downwardly-extending stirrer-paddle shaft of the stirring means; and said dissolution-vessel support and aligning guide means including dissolution vessel locking means including locking structure positioned to support said dissolution vessel in said centered state and position of said exact initial alignment when said inner diameter surfaces of said dissolution vessel are supported against said support and aligning guide means in a state of being aligned against inside diameter surfaces of the dissolution vessel, said dissolution-vessel support and aligning guide means and said anchoring means including con, non mounting structure providing for fixed spacial and positioning relationships of one to the other thereof.

12. A tablet dissolution vessel centering device comprising in combination: dissolution-vessel support and aligning guide means for loosely supporting an outer surface and for aligning inside diameter surfaces of a dissolution vessel having an upper opening with a center of the dissolution vessel supported and the upper opening in a centered state and position of exact alignment with a predetermined fixed-position for maintaining of a downwardly-extending lineally extending stirrer-paddle shaft on which during dissolution at-least one stirrer paddle is mounted on a lower end thereof for stirring matter dissolvable in liquid contained during matter dissolution in the dissolution vessel; stirring means for stirring liquid contained in the dissolution vessel during operational use thereof, the stirring means including said downwardly-extending lineally-extending stirrer-paddle shaft and at-least one stirrer paddle; stirring means support structure adapted to provide support to maintain said stirring means in said centered state of exact alignment as a predetermined fixed stirring position; stirrer anchoring means for mounting said stirring means support structure in said predetermined fixed stirring position such that said center of the dissolution vessel is always in said centered state and position in exact initial alignment with a fixed-position of the downwardly-extending stirrer-paddle shaft of the stirring means; and said dissolution-vessel support and aligning guide means including dissolution vessel locking means including locking structure positioned to support said dissolution vessel in said centered state and position of said exact initial alignment when said inner diameter surfaces of said dissolution vessel are upwardly supported against said support and aligning guide means in a state of being aligned against inside diameter surfaces of the dissolution vessel, said dissolution-vessel support and aligning means including a platform structure having hole-forming structure forming at-least one dissolution vessel-receiving space through said platform structure, the dissolution vessel-receiving space being of a size sufficiently to loosely support an outwardly extending flange of a dissolution vessel within said dissolution vessel-receiving space.

13. A tablet dissolution vessel centering device comprising in combination: dissolution-vessel support and aligning guide means for loosely supporting an outer surface and for aligning inside diameter surfaces of a dissolution vessel having an upper opening with a center of the dissolution vessel supported and the upper opening in a centered state and position of exact alignment with a predetermined fixed-position for maintaining of a downwardly-extending lineally-extending stirrer-paddle shaft on which during dissolution at-least one stirrer paddle is mounted on a lower end thereof for stirring matter dissolvable in liquid contained during matter dissolution in the dissolution vessel; stirring means for stirring liquid contained in the dissolution vessel during operational use thereof, the stirring means including said downwardly-extending lineally-extending stirrer-paddle shaft and at-least one stirrer paddle; stirring means support structure adapted to provide support to maintain said stirring means in said centered state of exact alignment as a predetermined fixed stirring position; stirrer anchoring means for mounting said stirring means support structure in said predetermined fixed stirring position such that said center of the dissolution vessel is always in said centered state and position in exact initial alignment with a fixed-position of the downwardly-extending stirrer-paddle shaft of the stirring means; and said dissolution-vessel support and aligning guide means including dissolution vessel locking means including locking structure positioned to support said dissolution vessel in said centered state and position of said exact initial alignment when said inner diameter surfaces of said dissolution vessel are supported against said support and aligning guide means in a state of being aligned against inside diameter surfaces of the dissolution vessel, including said dissolution vessel and said dissolution vessel has an upper mouth having outer circumscribing surfaces, and in which said dissolution-vessel support and aligning guide means includes intermittently lockable and releasable fastening structures spaced-apart from one-another in predetermined fastening positions on said dissolution vessel support structure positioned around said upper mouth and outer circumscribing surfaces thereof when said dissolution vessel is pressed against said aligning and holding means, said dissolution-vessel support and aligning means including a platform structure having hole-forming structure forming at-least one dissolution vessel-receiving space through said platform structure, the dissolution vessel-receiving space being of a size sufficiently to loosely support an outwardly extending flange of a dissolution vessel within said dissolution vessel-receiving space.

* * * * *